United States Patent [19]

Eisele

[11] 4,081,076

[45] Mar. 28, 1978

[54] CHILD-PROOF MATCH CONTAINER

[76] Inventor: Jean Paul Eisele, 6 Morris La., Great Neck, N.Y. 11024

[21] Appl. No.: 710,425

[22] Filed: Aug. 2, 1976

[51] Int. Cl.[2] ..... A24F 27/00

[52] U.S. Cl. ..... 206/106; 206/115

[58] Field of Search ..... 206/92, 96, 104, 106, 206/108–110, 115, 118, 1.5; 229/76

[56] References Cited

U.S. PATENT DOCUMENTS

| | | | |
|---|---|---|---|
| 1,594,511 | 8/1926 | Swigert et al. | 229/76 |
| 1,887,503 | 11/1932 | Freedman | 206/115 |
| 1,939,567 | 12/1933 | O'Malley | 206/108 |
| 2,665,000 | 1/1954 | Antoski | 206/115 |
| 3,220,637 | 11/1965 | Yee | 229/76 |
| 3,917,057 | 11/1975 | Bruzzano | 206/104 |
| 3,972,416 | 8/1976 | Underwood | 206/106 |
| 4,006,819 | 2/1977 | Elliott | 206/104 |

*Primary Examiner*—Steven E. Lipman
*Attorney, Agent, or Firm*—Joseph T. Eisele

[57] ABSTRACT

The disclosure is of a safety match container which gives an adult ready access to the contained matches but which is not easily opened by an infant. The preferred embodiment is a container fabricated from a tear-resistant, polymeric resin material and including a lock structure which permits the container to be opened only when the container itself is held and manipulated in a specific manner recognized by an adult but not generally by an infant.

7 Claims, 16 Drawing Figures

FIG. 1A
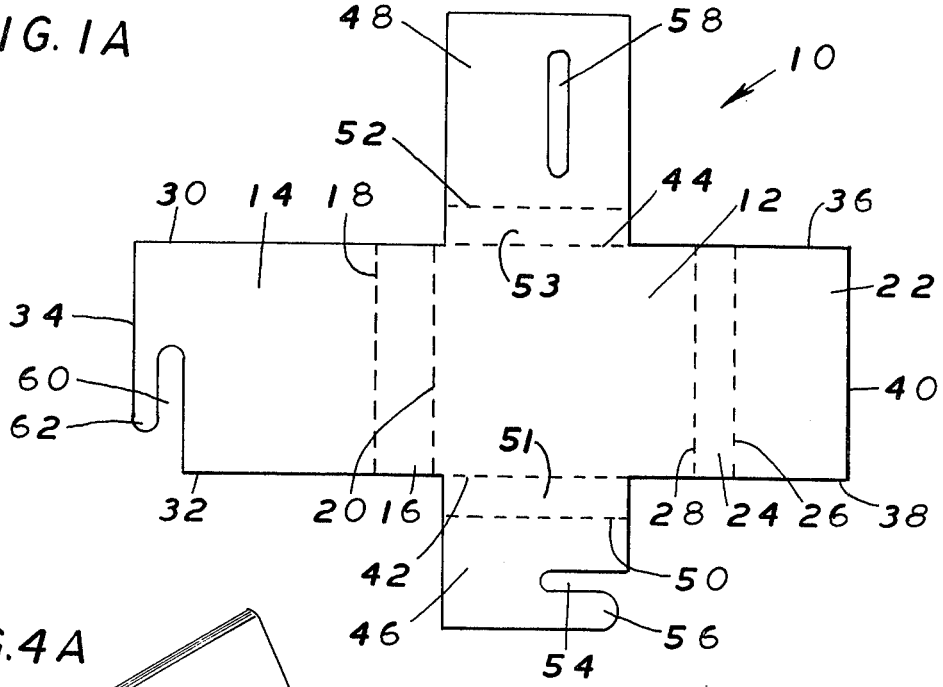
FIG. 4A
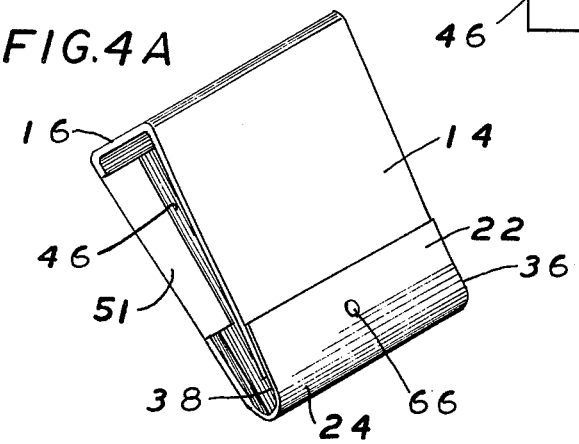
FIG. 2A
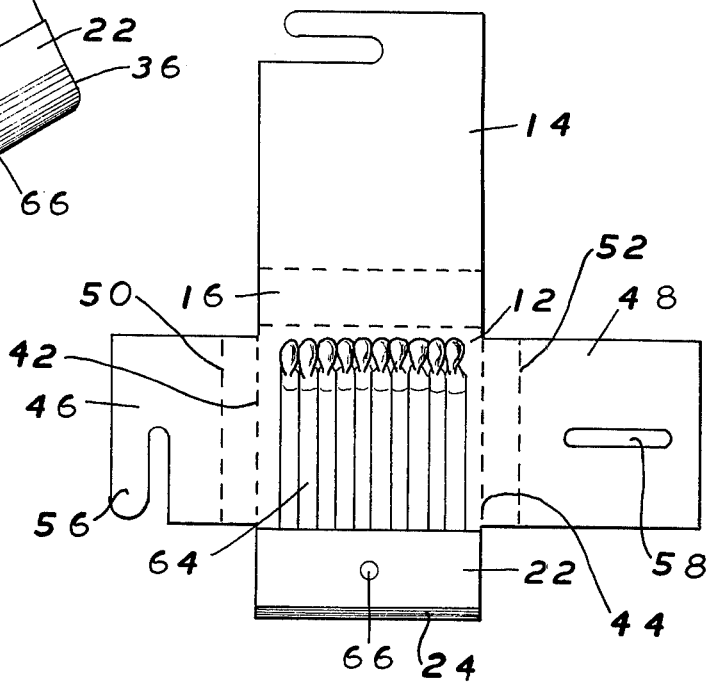
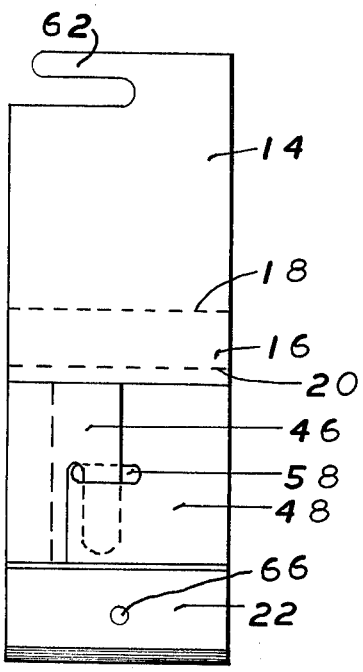
FIG. 3A

FIG. 1C
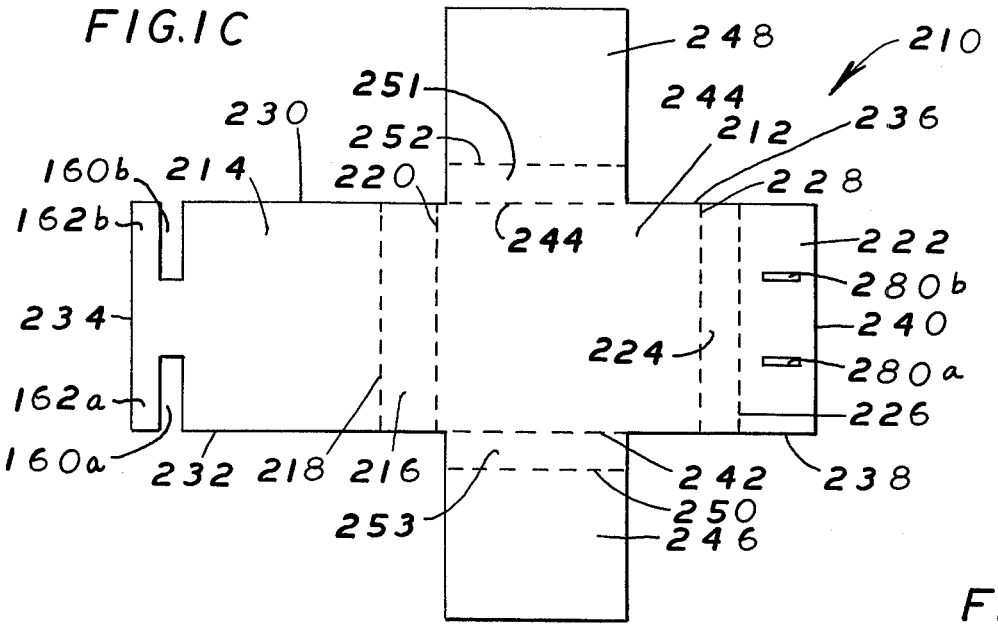
FIG. 3C
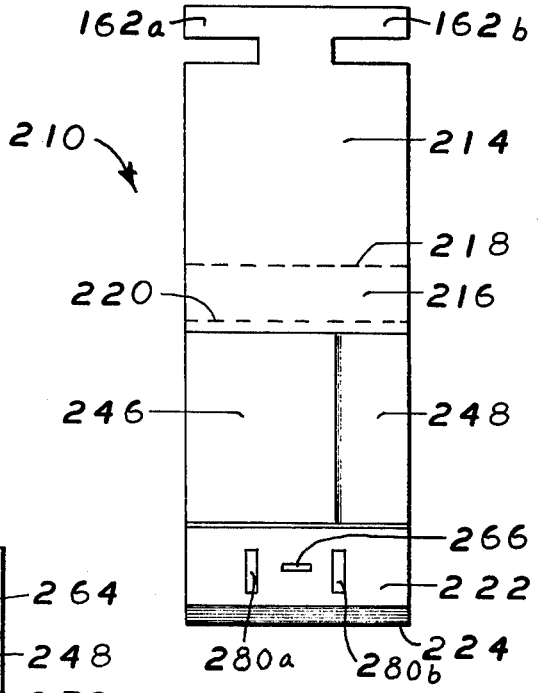
FIG. 2C
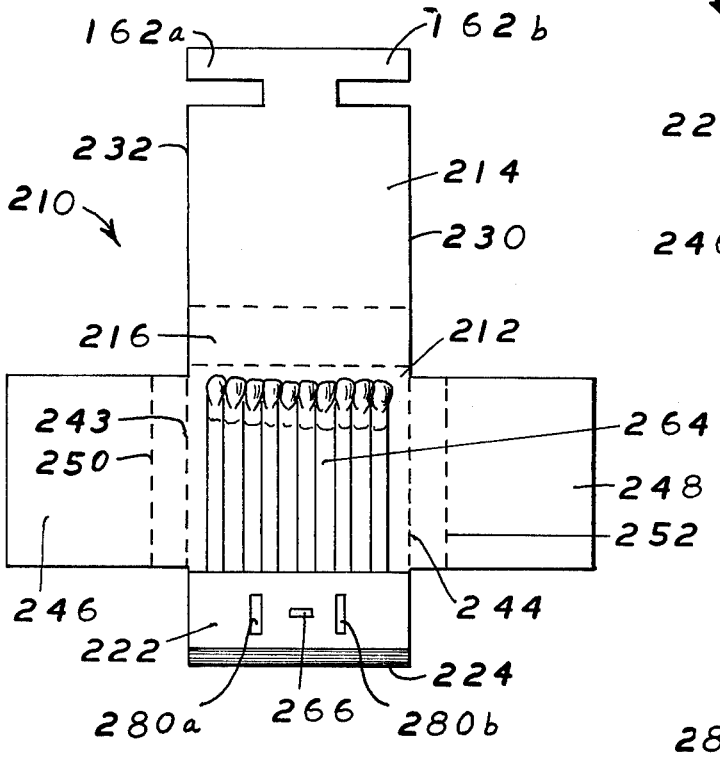
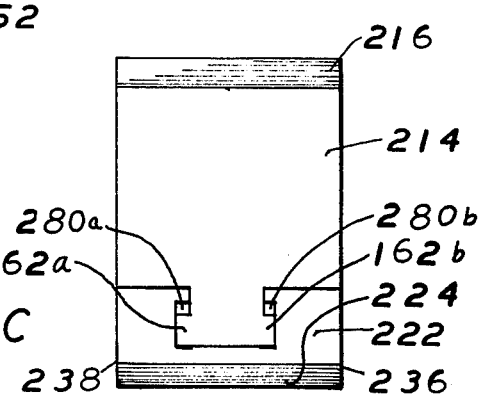
FIG. 4C

FIG. 5A
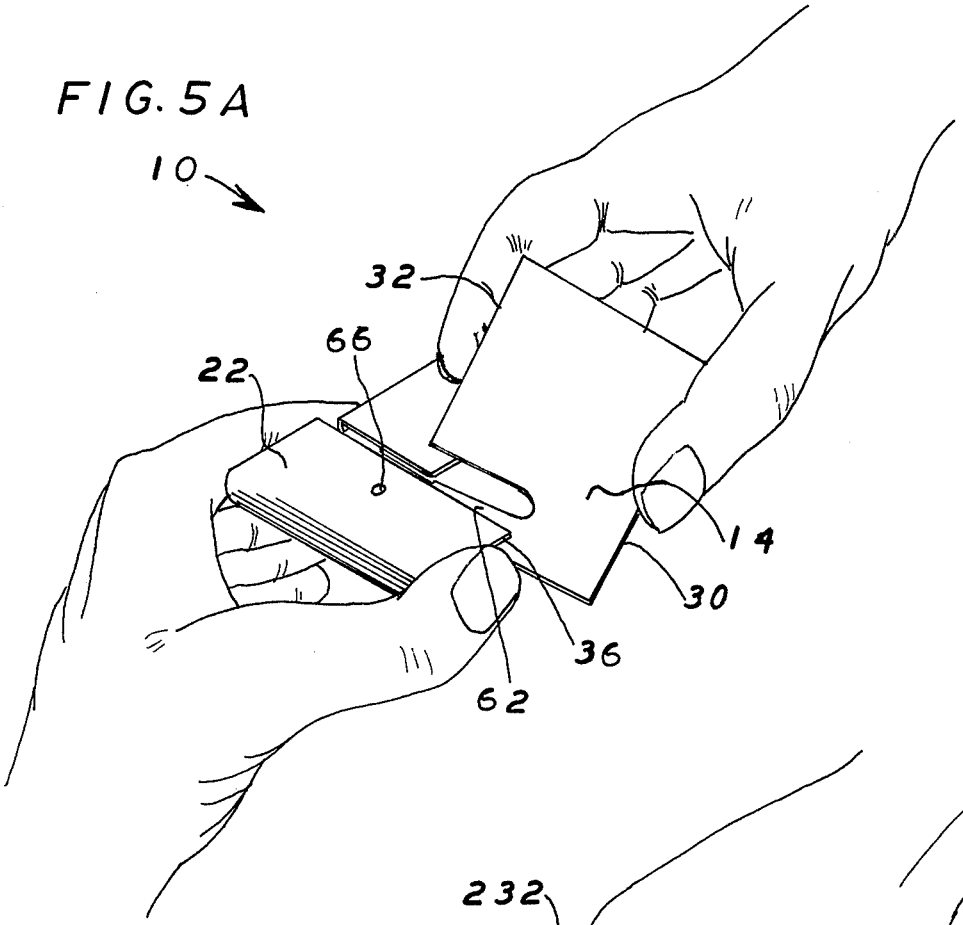
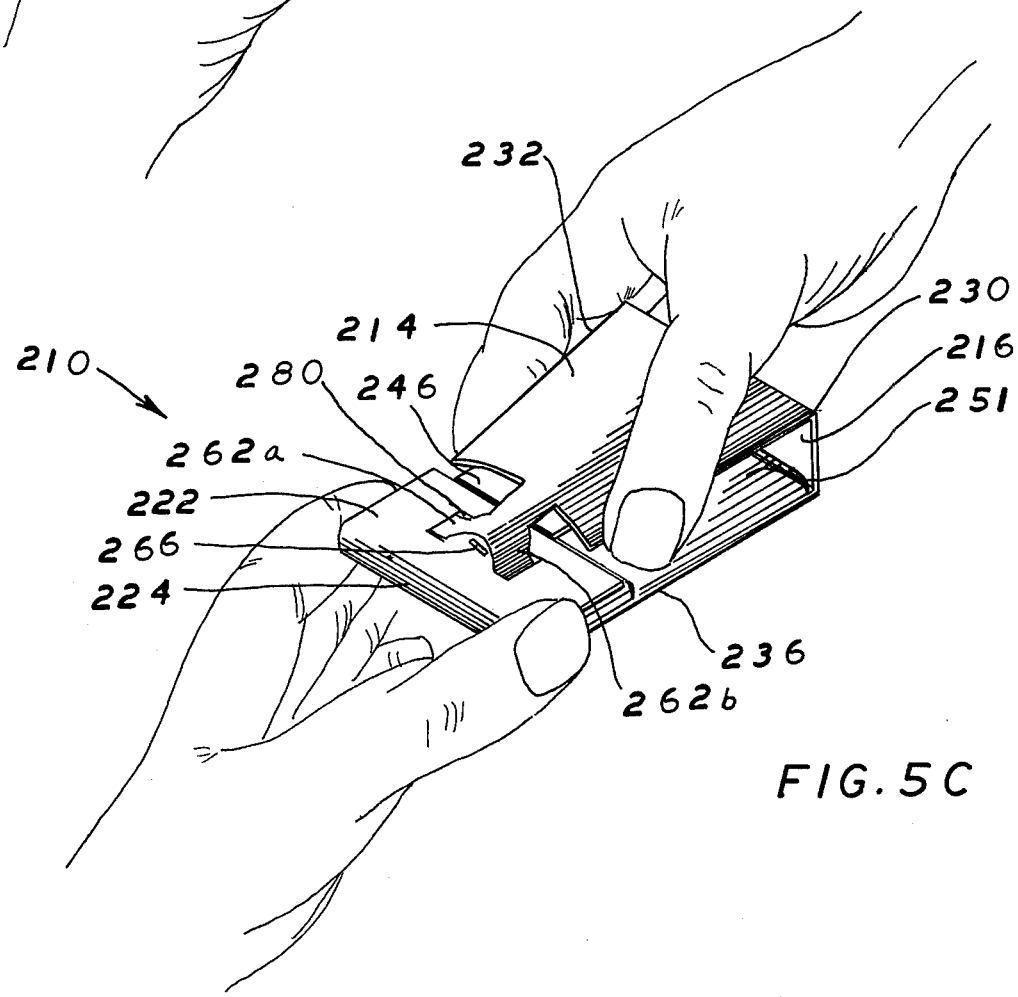
FIG. 5C

CHILD-PROOF MATCH CONTAINER

BACKGROUND OF THE INVENTION

1. Field of the Invention

The invention relates to safety containers and more specifically relates to the packaging of safety matches.

2. Brief Description of the Prior Art

Representative of the prior art are the match containers disclosed in U.S. Pat. Nos. 764,520; 1,172,276; 1,885,856; 1,893,655; 2,041,035; and 2,117,281.

In general, none of the prior art safety match containers have offered any difficulty to an infant intent upon opening the container and gaining access to the contained matches. This, of course, is a hazard to the infant since the chemical substances comprising the matches may be hazardous to the child both as toxicants and as flammable materials. The containers of my invention are readily opened by an adult but offer a challenge to the young infant and in that sense may be considered as "child-proof".

SUMMARY OF THE INVENTION

The invention comprises a safety match container, which comprises; a back panel having a top edge, a bottom edge and right and left side edges; a front panel having a top edge, a bottom edge and right and left side edges; a hinge joining the top edge of said back panel to the top edge of said front panel, said hinge permitting the bottom edge of said front panel and the back panel to pivot together and apart in an arc about said hinge and said hinge permitting a lateral pivoting of said back and front panels in respect to each other about a pivot point at the center of said hinge; a left sidewall joined to the left side edge of one of said back and front panels; a right sidewall joined to the right side edge of one of said back and front panels; a chamber for containing safety matches, defined by said hinge and front and back panels and sidewalls; means for mounting said matches in said chamber; and lock means for preventing the bottom edge of said front panel and the back panel from pivoting apart, said lock being releasable by the lateral pivoting of said back and front panels in respect to each other, about the pivot point at the center of said hinge.

BRIEF DESCRIPTION OF THE DRAWINGS

FIG. 1A is a scheme view of a container blank for a preferred container of the invention.

FIG. 2A is a front view of the container formed from the blank of FIG. 1A, showing it open for access to contained matches.

FIG. 3A is a front view of the embodiment seen in FIG. 2A but with the side walls closed.

FIG. 4A is an isometric view of the container of FIGS. 1A–3A with the cover closed and locked.

FIG. 5A is an isometric view showing operation of the embodiment container of FIGS. 1A–4A.

FIG. 1C is a scheme view of a container blank for another container embodiment of the invention.

FIG. 2C is a front view of the container formed from the blank of FIG. 1C shown open.

FIG. 3C is a view of the embodiment of FIG. 1C and 2C shown partly closed.

FIG. 4C is a front view of the embodiment of FIG. 1C–3C shown closed and locked.

FIG. 5C is an isometric view of the embodiment container of FIGS. 1C–4C shown in operation.

DETAILED DESCRIPTION OF THE PREFERRED EMBODIMENTS OF THE INVENTION

Figure 1B:
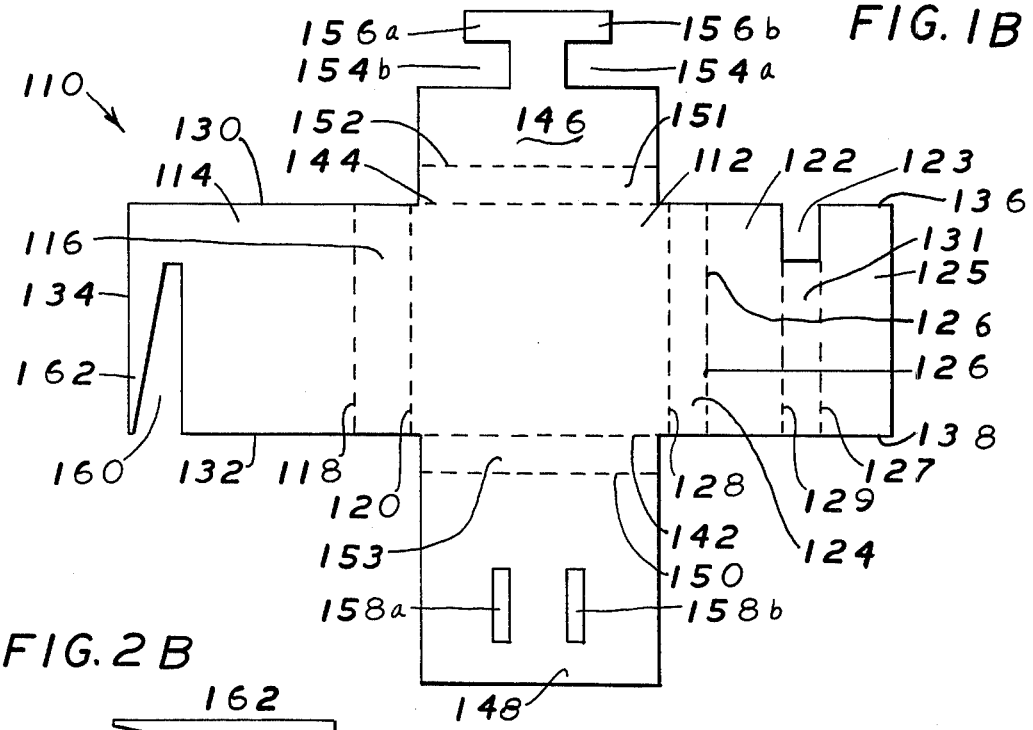
FIG. 1B is a scheme view for another container blank for forming another container of the invention.

An understanding of the invention is conveniently obtained by referring to the accompanying drawings of FIGS. 1A–5C in conjunction with the following description.

Referring first to FIG. 1A, a scheme view for a container blank, a preferred container of the invention will be detailed. Blank 10 comprises a back panel 12 and a front panel 14 separated by top panel 16. Top panel 16 is integral with front panel 14 being joined along fold line 18 and is integrally joined to back panel 12 along fold line 20. The top panel 16 acts as a hinge between panels 12 and 14, permitting pivotal movement of the edge 34 of front panel 14 together with and apart from back panel 12 in an arc about top panel 16. The top panel also acts as a hinge permitting lateral pivoting of panels 12, 14 in respect to each other about a point at the center of top panel 16. A cover panel 22 is joined to back panel 12 by bottom panel 24 which is defined by fold lines 26, 28 respectively. Front panel 14 is defined by the fold line 18, by side edges 30 and 32 and by top edge 34. The cover panel 22, bottom panel 24 and the lower part of back panel 12 share a continuous side edge 36 and an opposing side edge 38. Cover panel 22 is also bounded by a bottom edge 40. The back panel 12 is also bounded on opposing sides by fold lines 42 and 44 which are extensions of side edges 32, 38 and 30, 36 respectively. The foldline 42 is on a line between side edge 32 and side edge 38 while foldline 44 is on a line between side edge 30 and side edge 36. Fold line 42 forms a boundary line between back panel 12 and a side extension 46 thereof. On the opposite side fold line 44 forms a boundary line between back panel 12 and a side extension 48. Parallel to fold line 42 and in extension 46 is another fold line 50. The space between fold lines 42 and 50 is a side cover 51. Parallel to fold line 44 and in extension 48 is another fold line 52. Fold lines 44 and 52 define a side cover 53. A cut-out 54 is in extension 46, partially traversing extension 46 and parallel to fold line 50 to form a tab 56 on the distal edge of extension 46. A slit 58 is in extension 48 and runs at a 90° angle to the axis of the tab 56 and is on a line intercepting tab 56. Another tab 62 is on edge 34 of front panel 14 and is formed by cut-out portion 60.

FIG. 2A is a front view of the carton blank 10 shown assembled and open to expose contained matches 64. The matches 64 in a continuous strip are mounted against back panel 12 and secured by bottom panel 24 and cover panel 22 folded towards top panel 14 along fold lines 26, 28. The cover panel 22 is secured against matches 64 by rivet 66. To close the match container of blank 10, extension 48 is folded along fold lines 44 and 52 to cover matches 64. The extension 46 is then folded along fold lines 42 and 50 to cover folded extension 48. Inserting tab 56 into slit 58 lockes extensions 46 and 48 together, enclosing matches 64, as shown in FIG. 3A. Referring to FIG. 3A, a view as in FIG. 2A but with matches 64 enclosed by extensions 46, 48, the next step in closing the blank 10 may be seen. This next step is carried out by folding front panel 14 and top panel 16 toward cover panel 22 along fold lines 18, 20. The top panel 16 acts as a hinge permitting front panel 14 and back panel 12 to move together and apart along fold lines 18, 20. To secure front panel 14 as a further enclosure, it is twisted sideways and tab 62 is inserted under cover panel 22 below rivet 66. Rivet 66 traverses the cover panel 22 and back panel 12 and engages tab 62 so front panel 14 can not be opened by a direct pull away from cover panel 22. As seen in FIG. 4A, with the side covers including side cover 51, top panel 16, bottom panel 24, cover panel 22 and front and back panels 14, 12 enclosing matches 64, access to matches 64 is denied. Access to the contained matches 64 is obtained, as shown in FIG. 5A, by grasping front panel 14 along edges 30 and 32 and pivoting panel 14 about a point in the center of the hingelike top panel 16 so tab 62 is withdrawn from the side edge 36 of cover panel 22 thereby disengaging tab 62 from rivet 66. It should be noted that in order to withdraw tab 62 from under cover panel 22 and out of edge 36, it is necessary that the match container 10 be held in such a manner that cover panel 22 is not pressed downward to restrict movement of tab 62 and that edge 36 be free of obstruction which would also deny withdrawal of tab 62. Thus, to unlock and gain access to matches 64 it is necessary that one hold and manipulate the container 10 in a particular way. Other holding positions would prevent one from unlocking the front panel 14. After front panel 14 is unlocked and opened, the extensions 46, 48 are disengaged from each other by removing tab 56 from slit 58 and folding extensions 46, 48 outward to gain access to the matches 64.

Another embodiment container is shown in FIG. 1B—a scheme view for another blank 110. Blank 110 comprises a back panel 112 and a front panel 114 joined by top panel 116 which is defined by fold lines 118 and 120. The top panel 116 acts as a hinge permitting back panel 112 and front panel 114 to move together and apart along fold lines 118 and 120. The top panel 116 also acts as a hinge permitting the panels 112 and 114 to pivot laterally in respect to each other around the center point of panel 116. A cover panel 122 and a bottom panel 124 are lower integral extensions of back panel 112 and are formed by fold lines 126, 128 and 129. Between fold lines 127 and 129 is a foldover panel 131 having a cutaway portion 123 on side edge 136. A terminal flap 125 borders fold line 127. The front panel 114 is bordered by side edges 130 and 132 and top edge 134. A cut-away portion 160, triangular in shape with the base at edge 132 defines with top edge 134 a pointed flap 162. On one of the side boundaries of back panel 112 is a side cover panel 151 defined by fold lines 144 and 152. Distal to but integral with side cover panel 151 is side extension 146 which has cutaway portions **154*a* and 154*b* leaving extension flaps 156*a* and 156*b*. On the opposite side of back panel 112 is a side cover panel 153 defined by fold lines 142 and 150. Distal to side panel 153 but integral thereto is side extension 148 bearing slits 158*a* and 158*b*. The latter slits are positioned on an axis normal to the axis of flaps 156*a* and 156*b* and on a line midway between flaps 156*a* and 156*b***.

Figure 2B:
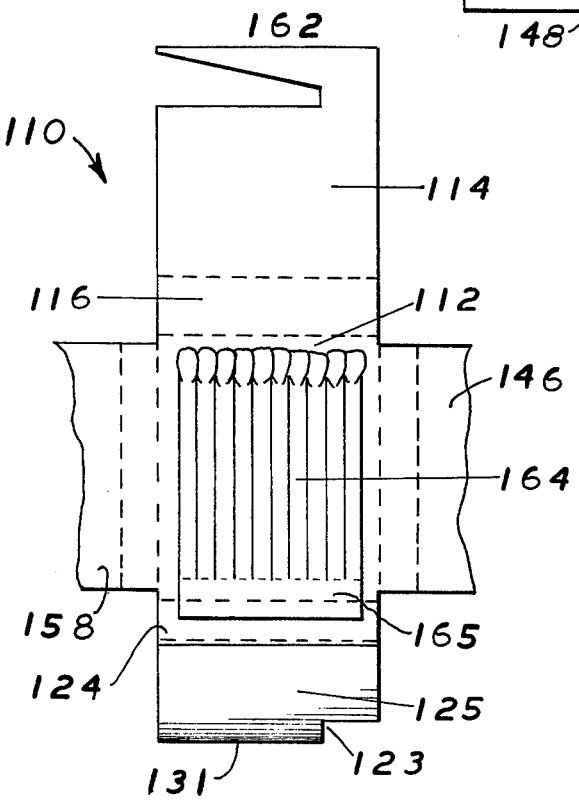
FIG. 2B is a front view in part of the container blank 1B shown partly assembled.
Figure 3B:
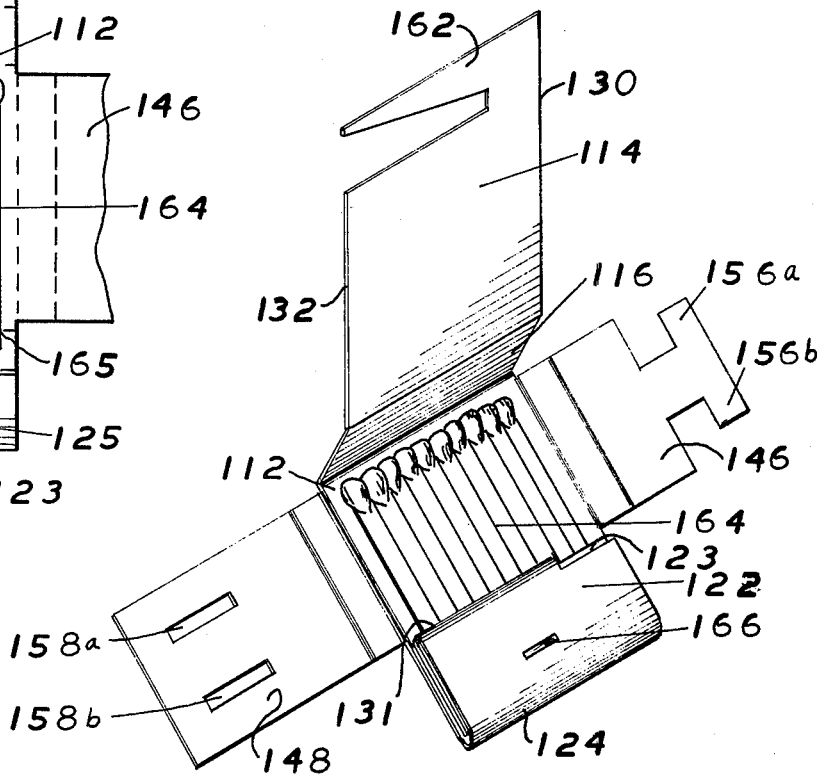
FIG. 3B is an isometric view of the embodiment container of FIG. 2B shown open.

The assembly of blank 110 into a match container may be followed by referring now to FIG. 2B, a front view-in-part of the blank 110. Matches 164 are on a tear strip 165 with the bottom edge of tear strip 165 positioned at the midline of bottom panel 124. Terminal flap 125 is folded toward and over cover panel 122 along fold lines 127 and foldover panel 131 is folded in the same direction along fold line 129. Referring now to FIG. 3B, an isometric view of the assembled container 110, it is seen that the cover panel 122 is then folded forward along fold line 126 to cover tear strip 165 and bottom panel 124 is formed as it folds forward along fold line 128. The cover panel 122 and the underlying panels are secured to back panel 112 by a staple 166 to complete assembly of the match container 110. Further details of the structure underlying cover panel 122 may be seen by referring to FIG. 6B, a cross-sectioned view along lines 6B—6B of FIG. 5B.

Figure 5B:
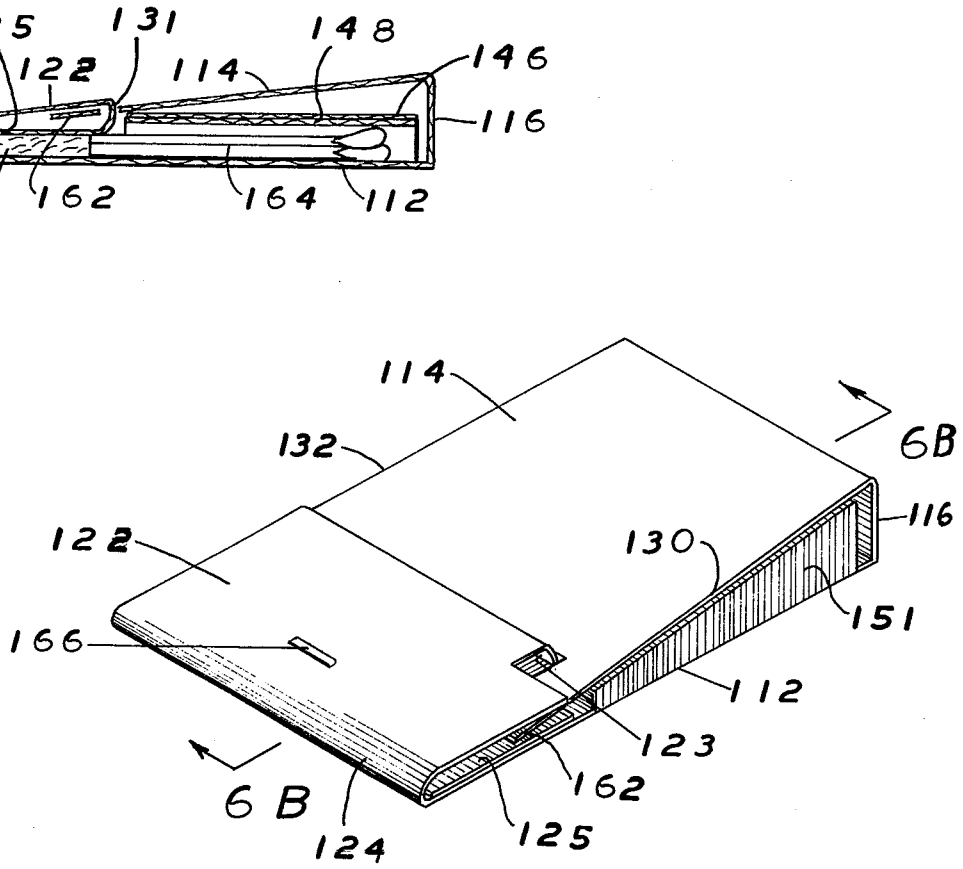
FIG. 5B is an isometric view of the embodiment of FIGS. 2B–4B shown closed and locked.
Figure 6B:
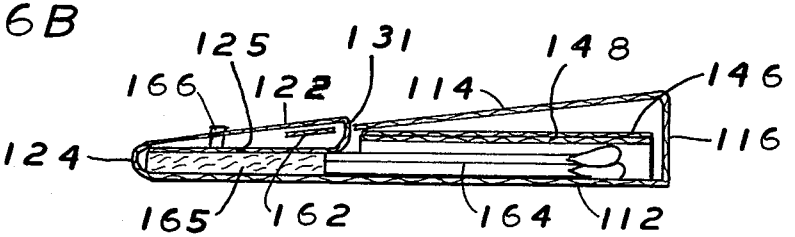
FIG. 6B is a cross-sectioned view along lines 6B–6B of FIG. 5B.
Figure 4B:
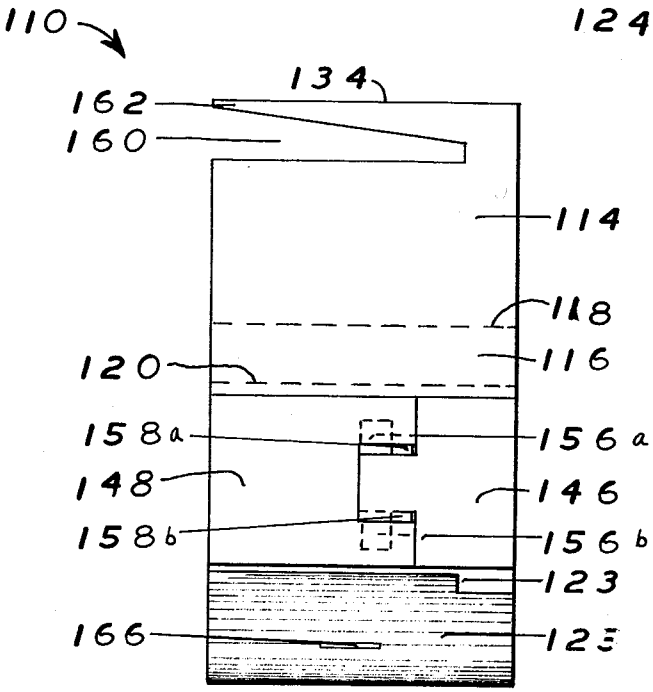
FIG. 4B is a front view of the embodiment of FIG. 3B shown partly closed.

The container 110 is closed to enclose and deny access to matches 164 by first folding side extension 148 towards extension 146 along fold lines 150 and 153 so as to cover matches 164 through the side of container 110. The extension 146 is then folded towards extension 148 along fold lines 144 and 152, simultaneously forming side cover 151 to close the opposite side of container 110, thereby completing the enclosure of matches 164 as shown in FIG. 4B. The extensions are locked together by inserting the flaps **156*a* and 156*b* into slits 158*a* and 158*b*, respectively. Finally, enclosure of the matches 164 is completed by folding front panel 114 towards cover panel 122 along fold lines 118 and 120 to simultaneously form top panel 116. The front panel 114 is secured to deny ready access to the matches 164 contained in container 110 by twisting or pivoting panel 114 about the pivot point at the center of top panel 116 in the same manner described above in relation to the embodiment container 10. The flap 162 is then inserted between cover panel 122 and terminal flap 125 as shown in FIG. 5B, an isometric view of the closed container 110. The flap 162 positioned between cover panel 122 and terminal flap 125 locks the container closed and denys movement of panel 114 away from cover panel 122 unless the container is held along edges 130 and 132 of panel 114 and along the lateral margins of bottom panel 124. Holding the container 110 as described, the panel 114 must then be pivoted around the center point of top panel 116 while withdrawing flap 162 from under cover panel 122 in order to initiate the opening of container 110. The structured details of the closed container 110** may be seen in further detail by referring to FIG. 6B, a cross-sectional view along lines 6B—6B of FIG. 5B.

Those skilled in the art will appreciate that to gain access to the matches in container 110, it is necessary that one hold the container 110 without pressing down on cover 122 and without blocking the area where tab 162 is to be withdrawn from engagement between cover panel 122 and terminal flap 125. In addition, it is necessary that one not grasp the side covers 151 or 153 since that would block pivoting of the panels 112 and 114 in respect to one another. Thus, holding the container only in a certain manner, i.e.; only along edges 130, 132 and 136, 138, one must then pivot the panels 112 and 114 laterally in respect to each other to unlock the panel 114 and gain access to the inner aspects of the container. Then the side panels 156, 158 must be disengaged from each other to gain access to the matches 164. The position of the grip and the manipulation for unlocking is readily appreciated and understood by an adult but offers a challenge to the average infant.

FIG. 1C is a schematic plan view of yet another embodiment container blank 210 which comprises a back panel 212 and a front panel 214 separated by top panel 216. Top panel 216 is integral with panels 212, 214 and is defined by fold lines 218 and 220 which function to permit top panel 216 to act as a hinge between panels 212 and 214 in the same way top panel 16 functioned for panels 14, 16 in the embodiment container 10 previously described. A cover panel 222 and bottom panel 224 are extensions of the one edge of back panel 212 and are defined in part by the fold lines 226 and 228. The front panel 214 is bounded in part by side edges 230 and 232 and by top edge 234. A cutaway portion 160*a* on edge 232 forms flap 162*a* on edge 234 and an opposite cutaway portion 160*b* on edge 230 forms flap 162*b* on edge 234. Opposite flaps 162*a* and 162*b* are slits 280*a* and 280*b*, respectively, cut into cover panel 222 at positions on a line midway through flaps 162*a* and 162*b* and in the direction of the axis normal to the axis of flaps 162*a* and 162*b*. Side cover flaps 251 and 253 are on opposite sides of back panel 212 and are defined by fold lines 244, 252 and 242, 250, respectively. Extended distal to fold line 250 is an integral side extension 246 and extended distal to fold line 252 is an integral side extension 248.

The embodiment container blank 210 is assembled by inserting a strippable sheet of matches 264 upon back panel 212 and folding cover panel 222 towards front panel 214 along fold lines 226 and 228. FIG. 2C is a front view of the assembled container blank 210 showing matches 264 secured therein by staple 266 joining cover panel 222 to back panel 212. Referring to FIG. 3C, a front view similar to that of FIG. 2C, one can see the partially closed container 210 formed by folding side extensions 246, 248 towards one another along fold lines 243, 250 and 244, 252, respectively. The sides of matches 264 are closed in by side cover panels 251 and 253 (not seen in FIG. 3C) and the top and bottom sides by panels 212, 246 and 248. Enclosure of the matches 264 is completed by folding front panel 214 towards cover panel 222 along fold lines 218 and 220 to simultaneously form top panel 216 as seen in FIG. 4C. FIG. 4C also shows front panel 214 locked to cover panel 222 by insertion of flaps 162*a* and 162*b* into slits 280*a* and 280*b*, respectively.

As shown in FIG. 4C, the embodiment container 210 completely encloses matches 264 and denys access thereto. The flaps 162*a* and 162*b* are of such length that to open the container 210 the container must be held in a certain manner and manipulated in a certain way. Referring to FIG. 5C, an isometric view of the container 210 is seen being unlocked. The side cover 222 and/or lower side edges 236, 238 of back panel 212 are grasped with the fingers of one hand while the side edges 230, 232 of front panel 214 are grasped by fingers of another hand. The edges 230, 232 are squeezed together and front panel 214 pivoted about a point in the center of top panel 216 to free one of flaps 262*a* or 262*b* from slit 280*a* or 280*b*. Then front panel 214 is pivoted in the opposite direction to free the other of flaps 262*a* or 262*b* from its engagement with slit 280*a* or 280*b*. With cover panel 214 unlocked from its securement to cover panel 222, access to matches 264 is readily obtained. It should be noted that holding the container 210 in a different manner, for example by grasping the surface of cover panel 222, one presses panel 222 against flaps 262*a* and 262*b* making the unlocking procedure more difficult. Thus, an adult may readily determine how to open the container 210 but an infant will have a more difficult course in attempting to open the container 210.

The safety match containers of the invention may be fabricated from conventional materials, preferably having a relatively high resistance to tearing. Illustrative of such materials are tear-resistant cellulosics, synthetic polymeric resin films and the like. Preferred materials are illustrated by fabric reinforced papers, films or sheets of synthetic polymeric resins having a high tear resistance such as polyethylene terephthalate, high density polyethylene, polypropylene and the like, fiber reinforced papers and synthetic polymeric resin films and the like.

Those skilled in the art will appreciate that many modifications and variations of the above described embodiments may be made without departing from the spirit and the scope of the invention. For example, the containers of the invention may be made in a variety of dimensions and configurations and with a variety of materials.

What is claimed is:

1. A safety match container, which comprises;

a back panel having a top edge, a bottom edge and right and left side edges;

a front panel having a top edge, a bottom edge and right and left side edges;

a hinge joining the top edge of said back panel to the top edge of said front panel, said hinge permitting withdrawal of the bottom edge of said front panel away from the bottom edge of said back panel in a direction toward said hinge and permitting the bottom edge of said front panel and the back panel to pivot together and apart in an arc about said hinge and said hinge permitting a lateral pivoting of said back and front panels in respect to each other about a pivot point at the center of said hinge;

a left sidewall joined to the left side edge of one of said back and front panels;

a right sidewall joined to the right side edge of one of said back and front panels;

a cover panel extension of the bottom edge of the back panel;

a chamber for containing safety matches, defined by said hinge and front and back panels and sidewalls;

means for mounting said matches in said chamber; and lock means for preventing the bottom edge of said front panel from moving away from the bottom edge of said back panel in a direction toward said hinge and for preventing the bottom edge of said front panel and the back panel from pivoting apart in an arc about said hinge, said lock being releasable only by the lateral pivoting of said back and front panels in respect to each other, about the pivot point at the center of said hinge, said lock means comprising a tab formed on the bottom edge of said front panel and a tab engaging member for engaging said tab, mounted on the cover panel.

2. A safety match container according to claim 1 wherein said left and said right sidewalls may be releasably locked together.

3. A safety match container according to claim 1 wherein said means for mounting includes a staple.

4. A safety match container according to claim 1 wherein said lock means comprises a tab on the bottom edge of said front panel and means for engaging said tab associated with said back panel.

5. A safety match container according to claim 1 fabricated from polyethylene terephthalate.

6. A safety match container according to claim 1 fabricated from a tear-resistant material.

7. A safety match container according to claim 1 wherein said lock means comprises two opposing tabs on the bottom edge of said front panel and slits for receiving said tabs in the cover panel extension of said back panel.

* * * * *